US005918710A

United States Patent [19]

Sher

[11] Patent Number: 5,918,710

[45] Date of Patent: Jul. 6, 1999

[54] DO-IT-YOURSELF SET FOR FASTENING A PULL ROD AND CASTERS WITH A LUGGAGE AND THE LIKE

[76] Inventor: Yu-Yi Sher, 6 Alley 3, Lane 91, Section 1, Yan Der Tah Tau, Su Lin District, Taipei City, Taiwan

[21] Appl. No.: 08/837,308

[22] Filed: Apr. 9, 1997

[51] Int. Cl.[6] ..... A45C 4/14; A45C 13/22; A45C 13/26

[52] U.S. Cl. ..... 190/18 A; 190/39; 190/115; 190/127; 16/115

[58] Field of Search ..... 190/18 A, 115, 190/127, 30; 16/115

[56] References Cited

U.S. PATENT DOCUMENTS

| | | | |
|---|---|---|---|
| 3,257,120 | 6/1966 | Browning | 190/18 A X |
| 4,406,353 | 9/1983 | Walker | 190/18 A |
| 4,538,709 | 9/1985 | Williams et al. | 190/18 A |
| 4,596,397 | 6/1986 | Conti | 190/18 A X |
| 4,618,035 | 10/1986 | Mao | 190/18 A |
| 5,022,574 | 6/1991 | Cesari | 190/127 X |
| 5,108,119 | 4/1992 | Huang | 190/18 A X |
| 5,167,306 | 12/1992 | Carrigan, Jr. | 190/18 A |
| 5,291,976 | 3/1994 | Ku | 16/115 X |
| 5,431,262 | 7/1995 | Rekuc et al. | 190/127 X |
| 5,431,428 | 7/1995 | Marchwiak et al. | 16/115 X |
| 5,456,342 | 10/1995 | Rekuc et al. | 190/18 A |
| 5,498,010 | 3/1996 | Stube | 190/18 A X |
| 5,524,920 | 6/1996 | Tsai | 190/18 A X |
| 5,590,748 | 1/1997 | Chang | 190/115 X |
| 5,634,538 | 6/1997 | Tsai | 190/18 A |

*Primary Examiner*—Sue A. Weaver
*Attorney, Agent, or Firm*—Harrison & Egbert

[57] ABSTRACT

An assembly for forming a rollable piece of luggage having a U-shaped pull rod, two fastening members, a fastening frame, two caster members, and two locating members. The pull rod has two arms each having a retaining projection for engaging the fastening frame which is fastened with the shell of the piece of luggage, in conjunction with the fastening members. Each of two caster members has a caster frame and a caster fastened pivotally with the caster frame which is in turn fastened with the fastening frame and the locating members.

1 Claim, 6 Drawing Sheets

DO-IT-YOURSELF SET FOR FASTENING A PULL ROD AND CASTERS WITH A LUGGAGE AND THE LIKE

FIELD OF THE INVENTION

The present inventional relates generally to the accessories of luggage and the like, and more particularly to a pull rod and casters which are made separately and can be fastened to the luggage by a user of the luggage.

BACKGROUND OF THE INVENTION

Conventional luggage is generally provided with a pull rod and a plurality of casters to facilitate the moving of the luggage. The pull rod and the casters of conventional luggage are fastened fixedly with the frame or shell of the luggages at the time when the luggage is made in the factory. In view of the fact that an additional space is often needed for the pull rod and the casters, a relatively large space for storage or shipment of the conventional luggage is often called for, thereby resulting in an increase in the cost of doing business.

SUMMARY OF THE INVENTION

The primary objective of the present invention is therefore to provide an assembly of a pull rod and a plurality of casters with a piece of luggage and the like.

In keeping with the principle of the present invention, the foregoing objective of the present invention is attained by a piece of luggage having a pull rod and a plurality of casters, which are fastened with the piece of luggage. The shell of the baggage is provided with a fastening frame and two locating members for fastening a pull rod in conjunction with two fastening members. Two casters are fastened to caster frames, which are in turn fastened with the fastening frame and the locating member.

The foregoing objective, features, functions and advantages of the present invention will be more readily understood upon a thoughtful deliberation of the following detailed description of the embodiments of the present invention in conjunction with the accompanying drawings.

DETAILED DESCRIPTION OF THE EMBODIMENTS

Figure 1:
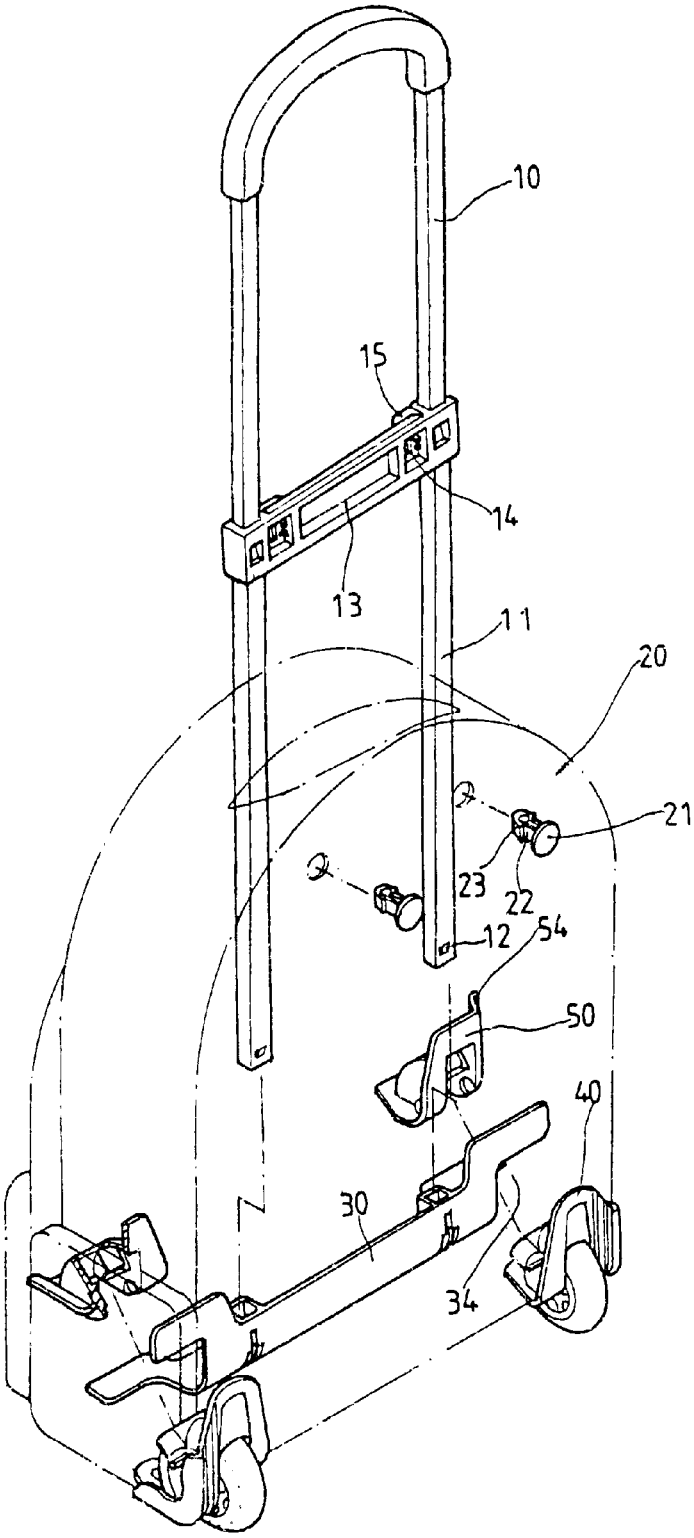
FIG. 1 shows an exploded view of a first preferred embodiment of the present invention.
Figure 2:
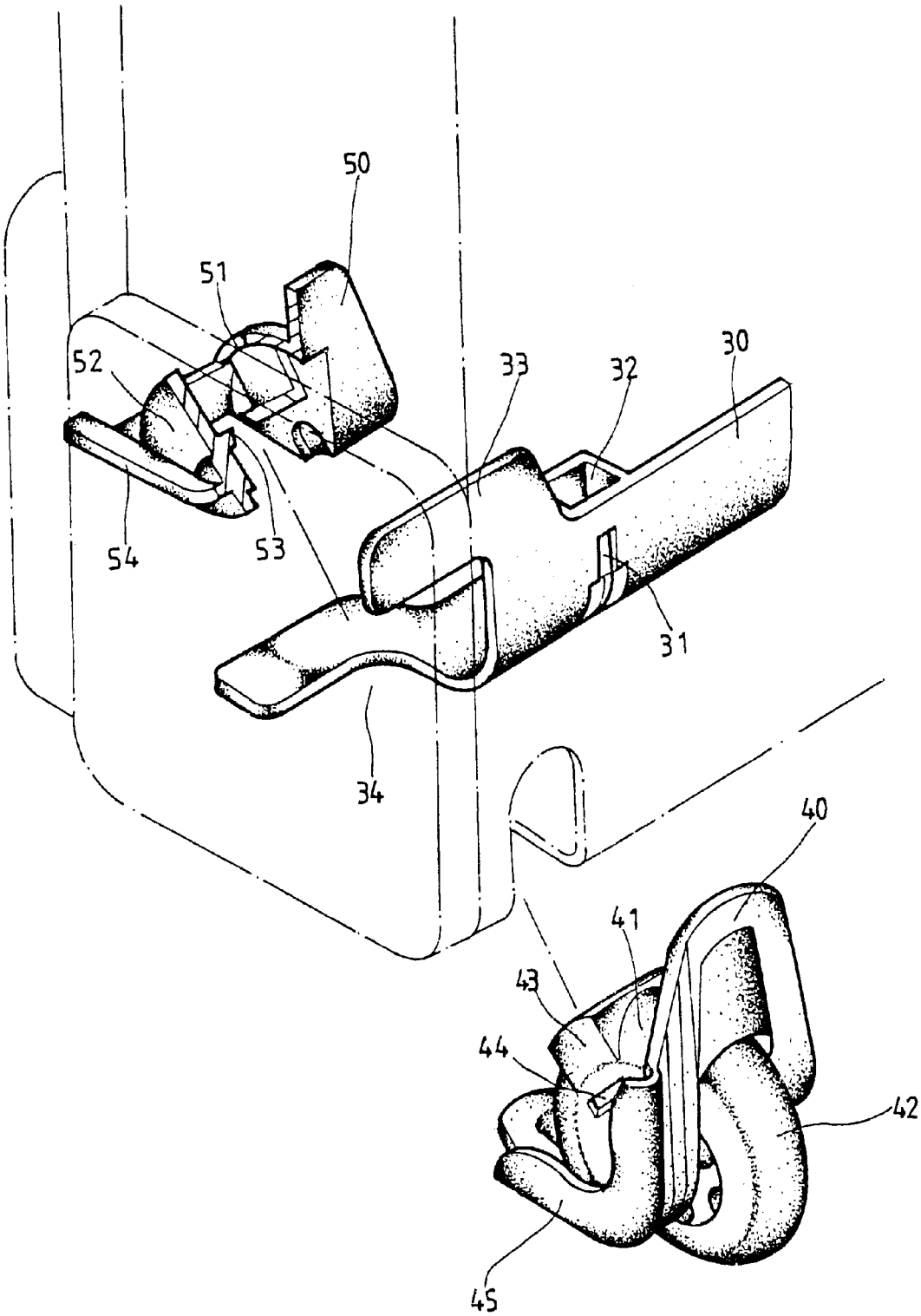
FIG. 2 shows a partial exploded view of the first preferred embodiment of the present invention.
Figure 3:
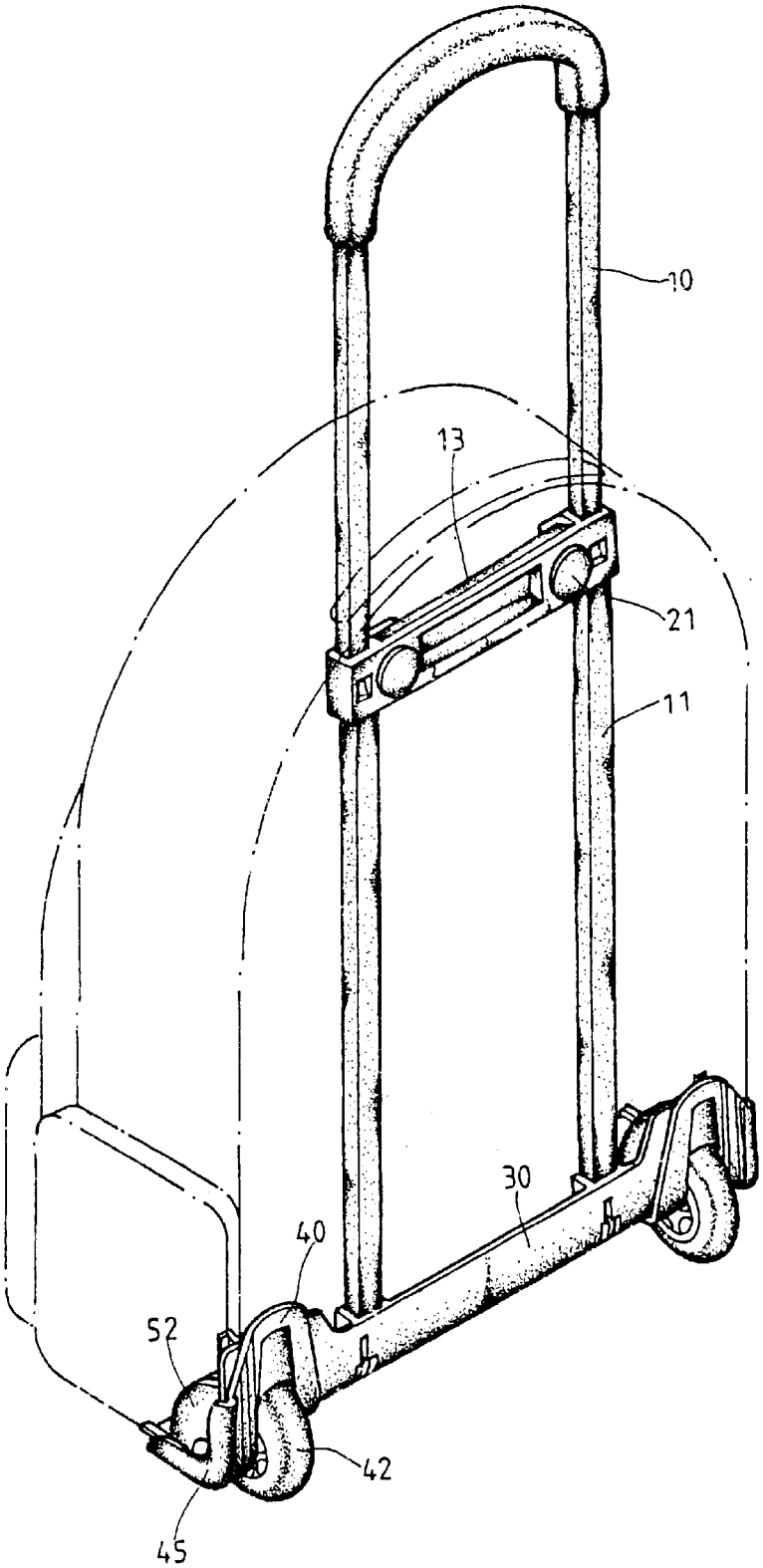
FIG. 3 shows a perspective view of the present invention in combination.
Figure 4:
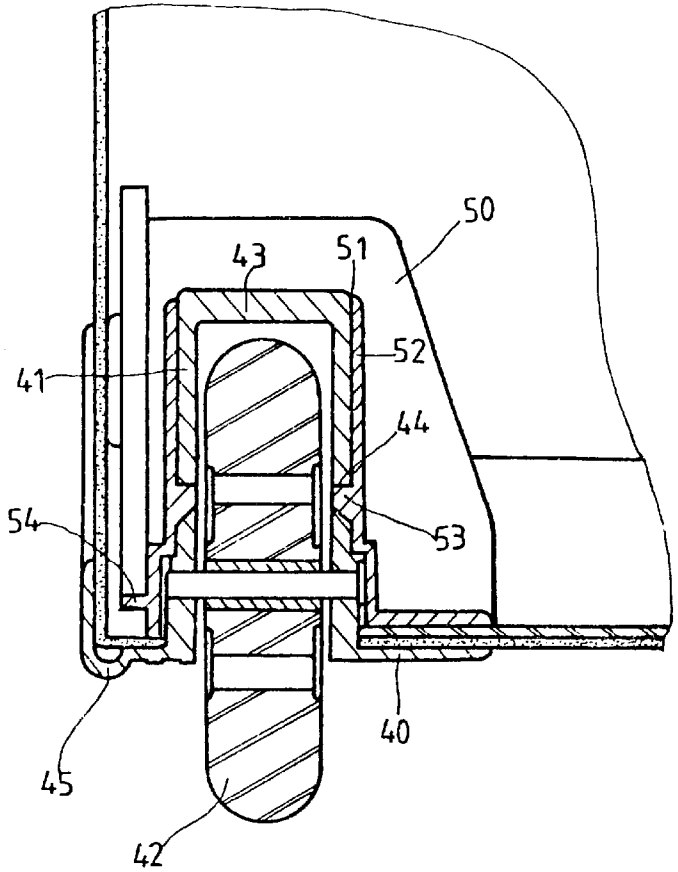
FIG. 4 shows a sectional view of the caster frame of the present invention.
Figure 5:
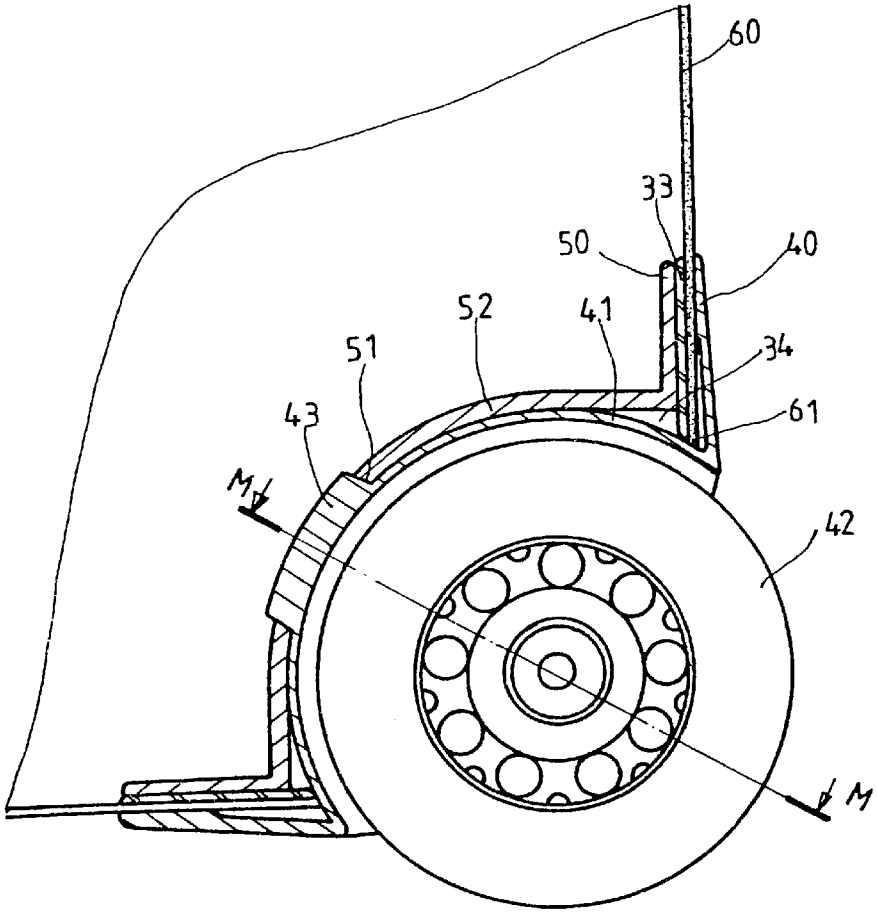
FIG. 5 shows another sectional view of the caster frame of the present invention.

As shown in FIGS. 1–7, the assembly embodied in the present invention is composed a shell, a pull rod 10, two fastening members 20, a fastening frame 30, two caster members 40, and two locating members 50. As used herein, the term "luggage" refers to luggage, boxes, handbags, and similar article transport devices.

The pull rod 10 is of a U-shaped construction and is composed of two arms 11 which are provided respectively at the free end thereof with a retaining projection 12. Located at the midsegment of the pull rod 10 is a fastening seat 13 having two fastening holes 14 which are provided respectively with an insertion slot 16 and two protective plates 15 opposite to each other.

The fastening frame 30 is fastened with the luggage shell such that the fastening frame 30 is perpendicular to the arms 11 of the U-shaped pull rod 10. The fastening frame 30 is provided with two fitting holes 32 each having a retaining slot 31 which is engaged with the retaining projection 12 of the arms 11 of the pull rod 10. The fastening frame 30 is provided respectively at both longitudinal ends thereof with a wing 34 having a retaining arm 33.

Two caster members 40 each comprise a caster frame 41 and a caster 42 fastened rotatably to the caster frame 41. The caster frame 41 is provided with a protruded portion 43, a depression 44, and a protective edge 45.

The locating members 50 are provided with a cover 52 having an opening 51 corresponding in location to the protruded portion 43 of the caster frame 41. The cover 52 is provided with a check hook 53 corresponding in location to the depression 44 of the caster frame 41. The locating members 50 are further provided with an urging edge 54 corresponding in location to the protective edge 45 of the caster frame 41.

Figure 6:
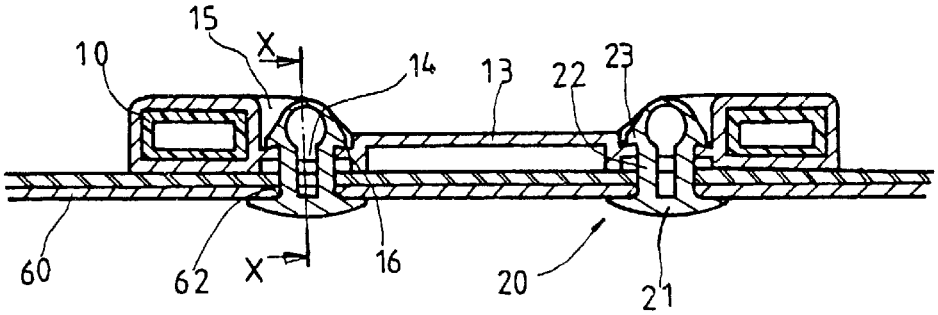
FIG. 6 shows a sectional view of the pull rod of the present invention.
Figure 7:
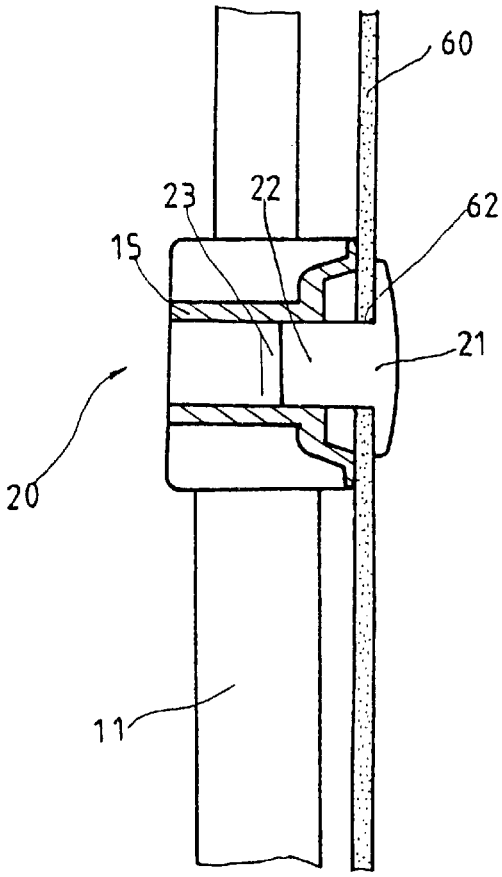
FIG. 7 shows another sectional view of the pull rod of the present invention.

In combination, the fastening frame 30 is secured within the luggage at the bottom of a luggage shell 60. The luggage shell 60 is provided with a through hole 61 on each side which correspond in location to the wings 34 of the fastening frame 30. The caster frame 41 of the caster member 40 is inserted into the retaining arm 33 before the locating member 50 is joined with the caster frame 41 such that the protruded portion 43 is engaged with the opening 51 of the locating member, and that the depression 44 is engaged with the check hook 53. In the meantime, the locating member 50 and the caster member 40 are located by the retaining arm 33. The arms 11 of the U-shaped pull rod 10 are engaged with the fitting holes 32 of the fastening frame 30 such that the retaining projections 12 of the arms 11 are retained by the retaining slots 31 of the fitting holes 32. The luggage shell 60 is provided with two holes 62 each corresponding in location to the fastening holes 14 of the fastening seat 13 and engageable with the fastening members 20, as shown in FIGS. 6 and 7. The body 22 of the fastening member 20 is held between the protective plates 15 of the fastening hole 14 such that the hooked end 23 of the fastening member 20 is engaged with the insertion slot 16 of the fastening hole 14.

Figure 8:
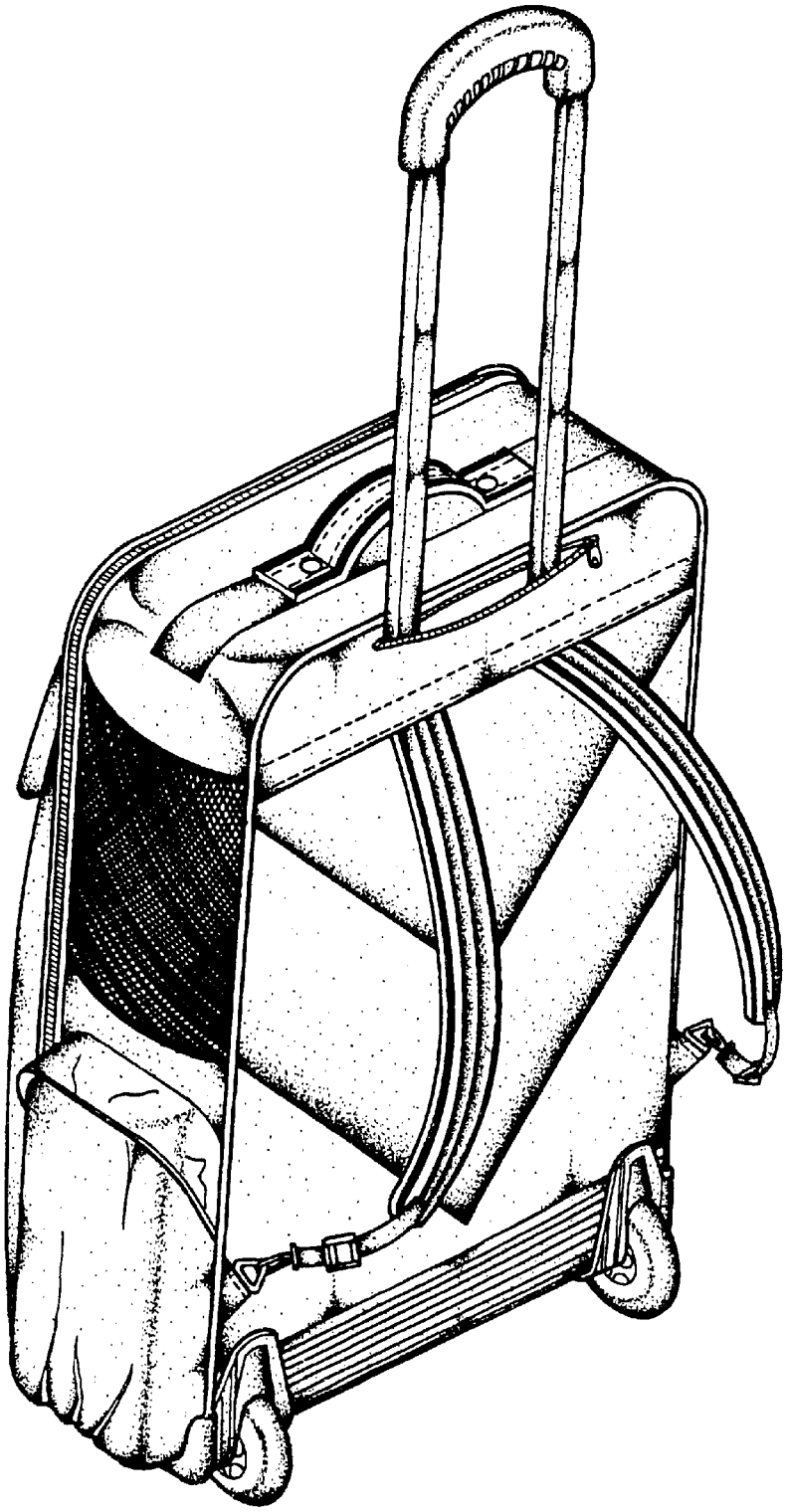
FIG. 8 shows a perspective view of a second preferred embodiment of the present invention.

The embodiment of the present invention described above is to be regarded in all respects as being merely illustrative and not restrictive. Accordingly, the present invention may be embodied in other specific forms without deviating from the spirit thereof. For example, a hand bag may be provided with the pull rod and the casters of the present invention, as illustrated in FIG.8. The present invention is therefore to be limited only by the scope of the hereinafter appended claim.

What is claimed is:

1. An apparatus comprising:

a piece of luggage having a back side and a bottom;

a pull rod of a U-shaped construction provided inside the piece of luggage adjacent the back side, and having two arms which are provided respectively at a free end thereof with a retaining projection, said arms further provided at a midsegment thereof with a fastening seat positioned inside the piece of luggage which has two fastening holes, said fastening holes of said fastening seat provided respectively with an insertion slot and a protective plate;

two fastening members each having a head, a body extending from said head, and a hooked end opposite to said head, said fastening members respectively extending through opening in the backside of the piece of the luggage said fastening holes of said fastening seat so as to engage said insertion slot and said protective plate so as to retain said back side of said piece of luggage against said pull rod;

a fastening frame fastened within said piece of luggage at said bottom of said piece of luggage such that said fastening frame is perpendicular to said arms of said pull rod, said fastening frame provided with two fitting holes each having a retaining slot engageable with said retaining projection of said arms of said pull rod, said fastening frame further provided respectively at both longitudinal ends thereof with a wing having a retaining arm;

two caster members each comprising a caster frame and a caster fastened rotatably with said caster frame, said caster frame provided with a protruded portion, a depression, and a protective edge; and two locating members each provided with a cover having an opening corresponding in location to said protruded portion of said caster frame, said cover provided with a check hook corresponding in location to said depression of said caster frame, each of said locating members further provided with an urging edge corresponding in location to said protective edge of said caster frame, said fastening frame being fastened to said bottom of said piece of luggage such that the wings of said fastening frame correspond in location to two holes respectively on said piece of luggage, said caster frame of said caster member being inserted into said retaining arm of said fastening frame, each of said locating members is joined respectively with each of the caster frames in such a way that said protruded portion is engaged with said opening of the locating member and that said depression of said caster frame is engaged with said check hook of the locating member and further that the locating member and the caster member are located by said retaining arm of said wing of said fastening frame, said arms of said pull rod being engaged with said fitting holes of said fastening frame such that the retaining projections of said arms are retained respectively by the retaining slots of said fitting holes of said fastening frame.

* * * * *